US011913657B2

(12) United States Patent
Reider et al.

(10) Patent No.: US 11,913,657 B2
(45) Date of Patent: Feb. 27, 2024

(54) METHOD AND A COMPUTER SYSTEM FOR MONITORING AND CONTROLLING AN HVAC SYSTEM

(71) Applicant: BELIMO Holding AG, Hinwil (CH)

(72) Inventors: Forest Reider, Seegraeben (CH); Stefan Mischler, Wald (CH)

(73) Assignee: BELIMO HOLDING AG, Hinwil (CH)

( * ) Notice: Subject to any disclaimer, the term of this patent is extended or adjusted under 35 U.S.C. 154(b) by 54 days.

(21) Appl. No.: 17/430,353

(22) PCT Filed: Apr. 8, 2020

(86) PCT No.: PCT/EP2020/060050
§ 371 (c)(1),
(2) Date: Aug. 12, 2021

(87) PCT Pub. No.: WO2020/233899
PCT Pub. Date: Nov. 26, 2020

(65) Prior Publication Data

US 2022/0128252 A1 Apr. 28, 2022

(30) Foreign Application Priority Data

May 20, 2019 (CH) ..... 00655/19

(51) Int. Cl.
*F24F 11/32* (2018.01)
*F24F 11/63* (2018.01)
*F24F 140/20* (2018.01)

(52) U.S. Cl.
CPC ..... *F24F 11/32* (2018.01); *F24F 11/63* (2018.01); *F24F 2140/20* (2018.01)

(58) Field of Classification Search
CPC ..... F24F 11/30; F24F 2110/10; F24F 11/46; F24F 11/65; F24F 11/58; F24F 11/74;
(Continued)

(56) References Cited

U.S. PATENT DOCUMENTS 5,705,734 A * 1/1998 Ahmed ..... F24F 11/0001 454/256
6,220,518 B1 * 4/2001 Kline ..... F24F 11/74 236/51

(Continued)

FOREIGN PATENT DOCUMENTS

CN 103946761 A 7/2014
CN 104272034 A 1/2015

(Continued)

OTHER PUBLICATIONS

Office Action dated Sep. 23, 2022 in Chinese Application No. 202080036351.1.

(Continued)

*Primary Examiner* — Darrin D Dunn
(74) *Attorney, Agent, or Firm* — Sughrue Mion, PLLC

(57) ABSTRACT

For monitoring and controlling an HVAC system which comprises one or more fluid transportation systems with a plurality of parallel zones, a plurality of operating variables of the fluid transportation systems are received (S1) from devices of the HVAC system. Temporal courses are determined (S3) for the operating variables. Interdependencies are determined (S4) between the temporal courses of the operating variables. Depending on the interdependencies, the operating variables and their associated devices are grouped (S5) into different sets which each relates to a different section of the HVAC system and includes the related operating variables and associated devices. The sets are used (S6) to control the devices of a particular section of the HVAC system and/or to generate a fault detection message regarding one or more of the devices of the particular section of the HVAC system.

22 Claims, 6 Drawing Sheets

(58) Field of Classification Search
CPC ..... F24F 11/79; F24F 11/54; F24F 2140/40; F24F 11/49; F24F 11/50; F24F 13/06; F24F 13/10; F24F 3/00; G05B 15/02; G05B 2219/2614; G05B 2219/2642; G05B 19/042; G05B 13/021; G05B 13/024; G05B 19/0426; G05B 2219/163
See application file for complete search history.

(56) References Cited

U.S. PATENT DOCUMENTS

| | | | | |
|---|---|---|---|---|
| 6,889,908 | B2 * | 5/2005 | Crippen | F24F 11/62 62/178 |
| 7,809,472 | B1 * | 10/2010 | Silva | F24F 11/62 236/1 C |
| 8,108,076 | B2 * | 1/2012 | Imes | F24F 11/30 700/278 |
| 8,550,370 | B2 * | 10/2013 | Barrett | F24F 3/044 62/77 |
| 8,688,243 | B2 * | 4/2014 | Federspiel | F24F 11/62 700/17 |
| 9,285,802 | B2 | 3/2016 | Arensmeier | |
| 9,429,923 | B2 * | 8/2016 | Ward | F24F 11/30 |
| 9,441,850 | B2 * | 9/2016 | Sato | F24F 3/065 |
| 9,638,436 | B2 | 5/2017 | Arensmeier et al. | |
| 9,703,287 | B2 | 7/2017 | Arensmeier | |
| 9,741,023 | B2 | 8/2017 | Arensmeier et al. | |
| 9,746,199 | B1 * | 8/2017 | Drees | F24F 11/76 |
| 10,208,973 | B2 | 2/2019 | Voigt et al. | |
| 10,274,945 | B2 | 4/2019 | Arensmeier et al. | |
| 10,373,126 | B2 | 8/2019 | Arensmeier et al. | |
| 10,386,800 | B2 | 8/2019 | Ahmed et al. | |
| 10,496,065 | B2 | 12/2019 | Conley et al. | |
| 10,544,956 | B2 | 1/2020 | Mady et al. | |
| 10,635,120 | B2 | 4/2020 | D'Silva et al. | |
| 10,641,512 | B2 * | 5/2020 | Otsuki | F24F 11/64 |
| 10,677,490 | B2 * | 6/2020 | Lo | F24F 11/81 |
| 10,884,403 | B2 | 1/2021 | Arensmeier | |
| 10,935,944 | B2 | 3/2021 | Ahmed et al. | |
| 11,060,744 | B2 | 7/2021 | Reider et al. | |
| 11,371,734 | B2 | 6/2022 | Aeberhard et al. | |
| 11,385,607 | B2 | 7/2022 | Ahmed et al. | |
| 2010/0114385 | A1 | 5/2010 | Dempster et al. | |
| 2010/0318226 | A1 * | 12/2010 | Augusto | F24F 3/00 236/49.5 |
| 2011/0046805 | A1 * | 2/2011 | Bedros | H04L 12/2809 700/291 |
| 2012/0239208 | A1 * | 9/2012 | Federspiel | F24F 11/62 700/277 |
| 2014/0337256 | A1 * | 11/2014 | Varadi | G05B 13/04 706/12 |
| 2014/0349566 | A1 * | 11/2014 | Lamb | F24F 11/76 454/258 |
| 2014/0358285 | A1 * | 12/2014 | Aggarwal | H05B 47/105 700/275 |
| 2015/0095000 | A1 * | 4/2015 | Patil | G06F 30/13 703/2 |
| 2015/0211943 | A1 * | 7/2015 | Kramer | G05D 23/10 374/1 |
| 2018/0087790 | A1 | 3/2018 | Perez | |
| 2018/0202679 | A1 | 7/2018 | Berg et al. | |
| 2018/0328615 | A1 * | 11/2018 | Lo | F24F 11/745 |
| 2019/0017720 | A1 * | 1/2019 | Otsuki | F24F 11/65 |
| 2019/0086107 | A1 | 3/2019 | Poluri et al. | |
| 2020/0400328 | A1 * | 12/2020 | Zhou | F24F 11/56 |
| 2021/0108815 | A1 * | 4/2021 | Boyer | G05B 15/02 |
| 2021/0156583 | A1 * | 5/2021 | Sabat | F24F 11/67 |
| 2022/0003447 | A1 * | 1/2022 | Williams | F24F 11/46 |

FOREIGN PATENT DOCUMENTS

| | | | |
|---|---|---|---|
| CN | 105074344 | A | 11/2015 |
| CN | 105283817 | A | 1/2016 |
| CN | 105910247 | A | 8/2016 |
| CN | 107223195 | A | 9/2017 |
| CN | 107436014 | A | 12/2017 |
| CN | 107743569 | A | 2/2018 |
| CN | 108431707 | A | 8/2018 |
| CN | 108779930 | A | 11/2018 |
| CN | 109328285 | A | 2/2019 |
| EP | 2 924 631 | A1 | 9/2015 |
| WO | 2014/172374 | A1 | 10/2014 |
| WO | 2015/004742 | A1 | 1/2015 |
| WO | 2017/146637 | A1 | 8/2017 |

OTHER PUBLICATIONS

Swiss Search Report for CH 6552019 dated Sep. 4, 2019.
International Search Report for PCT/EP2020/060050 dated Jul. 10, 2020 [PCT/ISA/210].
Written Opinion for PCT/EP2020/060050 dated Jul. 10, 2020 [PCT/ISA/237].

* cited by examiner

METHOD AND A COMPUTER SYSTEM FOR MONITORING AND CONTROLLING AN HVAC SYSTEM

CROSS REFERENCE TO RELATED APPLICATIONS

This application is a National Stage of International Application No. PCT/EP2020/060050 filed Apr. 8, 2020, claiming priority based on Swiss Patent Application No. 00655/19 filed May 20, 2019, the entire contents of each of which being herein incorporated by reference in their entireties.

FIELD OF THE INVENTION

The present invention relates to a method and a computer system for monitoring and controlling an HVAC (Heating, Ventilation, Air Conditioning and Cooling) system. Specifically, the present invention relates to a computer-implemented method and a computer system for monitoring and controlling an HVAC system which comprises one or more fluid transportation systems with a plurality of parallel zones in each of the fluid transportation systems.

BACKGROUND OF THE INVENTION

HVAC system for heating, ventilating, air conditioning and cooling one or more buildings comprise one or more fluid transportation systems for moving liquid or gaseous fluids to or through rooms or spaces of the buildings such as to distribute thermal energy. The fluid transportation systems comprise circuits with fluid transport lines, e.g. pipes for liquid fluids or ducts for gaseous fluids, and fluid transportation drivers, e.g. pumps for liquid fluids or ventilators for gaseous fluids, for driving and moving the fluid in the fluid transport lines through thermal energy sources, such as heaters or chillers. For regulating the flow of fluid through the HVAC systems or their fluid transportation systems, respectively, the HVAC systems further comprise adjustable flow control devices, e.g. valves regulating the flow of liquid fluids or dampers for regulating the flow of gaseous fluids. In the present context the term "valve" is used to refer to flow control devices for liquid and gaseous fluids and, thus, is meant to include "dampers" also. The individual valves are adjusted by actuators with electrical motors which are mechanically coupled to the respective valves. The HVAC systems further comprise sensors for measuring operating variables of the fluid transportation systems, such as temperature of the fluid, flow rate of the fluid, flow speed of the fluid, and pressure of the fluid at various points in the fluid transportation systems, or in the building, e.g. air temperature or other air quality parameters, such as humidity, carbon monoxide level, carbon dioxide level, or levels of other volatile organic compounds (VOC), etc. For a more flexible and more efficient regulation of the temperature and distribution of thermal energy, the HVAC systems or their fluid transportation systems, respectively, are divided into parallel zones ("zoning") which correspond to floors and/or rooms of a building, for example. For controlling the overall performance of an HVAC system and its fluid transportation systems, a building control or automation system is connected to the HVAC devices, including actuators, valves, sensors, pumps, ventilators, etc. More often than not, building control systems and HVAC devices are provided by different manufacturers and installed by different technical specialists and at different stages of a building's construction or renovation. Coordination of these various technical specialists at different stages and integration of building control systems and HVAC devices from different manufacturers cause considerable logistical and technical complexities, which often continue through the operational and maintenance life cycle of HVAC systems.

SUMMARY OF THE INVENTION

It is an object of this invention to provide a computer-implemented method and a computer system for monitoring and controlling an HVAC system, which do not have at least some of the disadvantages of the prior art. In particular, it is an object of the present invention to provide a computer-implemented method and a computer system for monitoring and controlling a multi-zone HVAC system, which method and computer system make it possible to monitor and improve operation of a multi-zone HVAC system, without having to rely entirely on a building control system.

According to the present invention, these objects are achieved through the features of the independent claims. In addition, further advantageous embodiments follow from the dependent claims and the description.

According to the present invention, the above-mentioned objects are particularly achieved in that a computer-implemented method of monitoring and controlling an HVAC system, which comprises one or more fluid transportation systems with a plurality of parallel zones in each of the fluid transportation systems, comprises one or more processors of a computer system performing the steps of: receiving via a communication network from a plurality of devices of the HVAC system a plurality of operating variables of the fluid transportation systems; determining for each of the operating variables a temporal course of the respective operating variable; detecting from the temporal courses of the operating variables interdependencies between the temporal courses of the operating variables; grouping the operating variables and their associated devices into different sets, depending on the interdependencies, each set being related to a different section of the HVAC system and including the operating variables and their associated devices related to the different section of the HVAC system; and using the sets to control the HVAC system by controlling the devices of a particular section of the HVAC system, using the operating variables related to the particular section of the HVAC system, and/or generating a fault detection message regarding one or more of the devices of the particular section of the HVAC system, using the operating variables associated with the one or more devices of the particular section of the HVAC system.

By grouping the operating variables and their associated devices into different sets, depending on the interdependencies between the temporal courses of the operating variables, a relationship is determined and defined between the measurable variables and contributing devices in an HVAC system. This makes it possible to determine which devices of the HVAC system belong together, e.g. they are connected to the same thermal energy source, without requiring a building control or automation system or having access to the data of a building control or automation system. Consequently, without the information from a building control or automation system, it is possible to not only monitor, analyze and control individual HVAC devices, such as pumps, ventilators, heaters, chillers, actuators, valves, dampers, radiators, heat exchangers, but also their interaction, interoperation, and interdependencies within the context and performance of the overall HVAC system. Therefore, operation and performance of a multi-zone HVAC system can be monitored, analysed and improved, without having to rely entirely on a building control system or a building automation system.

In an embodiment, the method further comprises the one or more processors receiving via the communication network from a plurality of devices of the HVAC system a plurality of setpoint values for the operating variables of the fluid transportation systems; determining for each of the setpoint values a temporal course of the respective setpoint value; detecting from the temporal courses of the setpoint values interdependencies between the temporal courses of the setpoint values; and using the interdependencies between the temporal courses of the setpoint values for grouping the setpoint values and their associated devices into the different sets.

In an embodiment, the operating variables of the fluid transportation systems comprise a fluid temperature; and the method further comprises the one or more processors detecting the interdependencies by determining correlations of the temporal courses of the fluid temperature, and grouping the operating variables and their associated devices into sets which are related to a different one of the fluid transportation systems and include the operating variables and their associated devices connected by the different one of the fluid transportation system to a common thermal energy source.

In an embodiment, the method further comprises the one or more processors identifying in the HVAC system thermal energy exchanging devices which couple a zone of a first one of the fluid transportation systems and a zone a second one of the fluid transportation systems as primary and secondary fluid circuits, by detecting interdependencies between the temporal courses of the operating variables grouped into sets related to different fluid transportation systems and zones.

In an embodiment, the method further comprises the one or more processors identifying the thermal energy exchanging devices by detecting the interdependencies between the temporal courses of the following pairs of operating variables: the flow of fluid in a first fluid transportation system and the fluid temperature in a second fluid transportation system, the valve position of a valve in a first fluid transportation system and the fluid temperature in a second fluid transportation system, the fluid supply temperature in the first fluid transportation system and the fluid temperature in the second fluid transportation system, the flow of fluid in a first fluid transportation system and the valve position of a valve in a second fluid transportation system, the valve position of a valve in a first fluid transportation system and the valve position of a valve in a second fluid transportation system, the fluid supply temperature in the first fluid transportation system and the valve position of a valve in a second fluid transportation system, and/or the valve position of a valve in the second fluid transportation system and the fluid return temperature in the first fluid transportation system.

In an embodiment, the method further comprises the one or more processors grouping the operating variables and their associated devices into sets which are related to a different zone of one of the fluid transportation systems and include the operating variables and their associated devices related to the different zone of the one of the fluid transportation systems.

In an embodiment, the method further comprises the one or more processors dividing the operating variables and their associated devices from the sets which are related to the different zones of a particular one of the fluid transportation systems into subsets which are related to parallel zones which are pressure-independent from the other zones of the particular one of the fluid transportation system.

In an embodiment, the method further comprises the one or more processors grouping the operating variables and their associated devices into sets which are each related to a particular area of a building which houses the HVAC system, the particular area of the building being characterized by a respective thermal load, and include the operating variables and their associated devices related to the particular area of the building.

In an embodiment, the method further comprises the one or more processors grouping the operating variables and their associated devices into sets which are each related to a particular area of a building which houses the HVAC system, the particular area of the building facing one of a particular cardinal direction characterized by a respective solar exposure on the particular cardinal direction, and include the operating variables and their associated devices related to the particular area of the building.

In an embodiment, the operating variables of the fluid transportation systems comprise: temperature of fluid, flow rate of the fluid, and pressure of the fluid; and the method further comprises the one or more processors detecting the interdependencies by determining correlations of the temporal courses of at least one of: temperature of fluid, flow rate of the fluid, and/or pressure of the fluid. The correlations of the temporal courses of the operating variables comprise positive correlation and negative correlation.

In an embodiment, the method further comprises the one or more processors detecting the interdependencies by determining from the temporal courses of the operating variables a synchronicity in changes of the operating variables.

In an embodiment, the method further comprises the one or more processors time-shifting the temporal courses of the operating variables, and detecting the interdependencies by determining a synchronicity in changes of the operating variables and/or a correlation of the operating variables, using time-shifted temporal courses of the operating variables.

In an embodiment, the method further comprises the one or more processors detecting from the temporal courses of the operating variables time delays between changes of the operating variables, and determining relative positions of the devices of the HVAC systems in the fluid transportation systems, using the time delays.

In an embodiment, the method further comprises the one or more processors grouping the operating variables and their associated devices into sets which are related to parallel zones of a particular one of the fluid transportation systems, each of the sets including the operating variables and their associated devices related to one of the parallel zones; and using the operating variables of the parallel zones of the particular one of the fluid transportation systems to control the devices of the parallel zones according to: a load balancing scheme, a peak shaving scheme, an adjusted flow distribution scheme for under-supply scenarios, and/or a fluid transportation driver optimization scheme.

In an embodiment, the method further comprises the one or more processors grouping the operating variables and their associated devices into sets which are each related to a particular one of the fluid transportation systems and include the operating variables and their associated devices related to the particular one of the fluid transportation systems; detecting oscillation of the operating variables related to the particular one of the fluid transportation systems; and setting altered timing parameters for the devices related to the particular one of the fluid transportation systems, upon detection of oscillation.

In an embodiment, the method further comprises the one or more processors receiving via the communication network from a plurality of sensor devices of the HVAC system a plurality of room temperature values; determining for each of the sensor devices a temporal course of the room temperature value; detecting interdependencies between the temporal courses of the room temperature values and the temporal courses of the operating variables; using the interdependencies between the temporal courses of the room temperature values and the temporal courses of the operating variables for assigning the sensor devices and their room temperature values to the different sets; and controlling the devices of a particular section of the HVAC system, using the room temperature values related to the particular section of the HVAC system.

In an embodiment, the method further comprises the one or more processors performing a system measurement phase by transmitting via the communication network to a plurality of devices of the HVAC system a plurality of setpoint values for the operating variables of the fluid transportation systems, and receiving the plurality of operating variables of the fluid transportation systems from the plurality of devices of the HVAC system in response to transmitting the setpoint values.

In an embodiment, the method further comprises the one or more processors using the operating variables of the particular section of the HVAC system to determine an HVAC system schedule, and using the HVAC system schedule to generate an alert message indicative of detected a deviation from the HVAC system schedule, and/or a help message indicative of a suggested change of the HVAC system schedule for a more energy efficient operation of the HVAC system.

In an embodiment, the method further comprises the one or more processors using the sets to generate a configuration model of the HVAC system, the configuration model being structured into one or more fluid transportation systems having one or more parallel zones and devices of the HVAC systems related to these zones; and to use the configuration model of the HVAC system for performing the controlling of the devices of the HVAC system and/or generating the fault detection message regarding the one or more of the devices of the HVAC system.

In addition to the computer-implemented method of monitoring and controlling a multi-zone HVAC system, the present invention also relates to a computer system for monitoring and controlling an HVAC system which comprises one or more fluid transportation systems with a plurality of parallel zones in each of the fluid transportation systems. The computer system comprises one or more processors configured to perform the steps of the computer-implemented method of monitoring and controlling the multi-zone HVAC system. Specifically, the computer system comprises one or more processors configured to perform the steps of: receiving via a communication network from a plurality of devices of the HVAC system a plurality of operating variables of the fluid transportation systems; determining for each of the operating variables a temporal course of the respective operating variable; detecting from the temporal courses of the operating variables interdependencies between the temporal courses of the operating variables; grouping the operating variables and their associated devices into different sets, depending on the interdependencies, each set being related to a different section of the HVAC system and including the operating variables and their associated devices related to the different section of the HVAC system; and using the sets to control the HVAC system by controlling the devices of a particular section of the HVAC system, using the operating variables related to the particular section of the HVAC system, and/or generating a fault detection message regarding one or more of the devices of the particular section of the HVAC system, using the operating variables associated with the one or more devices of the particular section of the HVAC system.

In addition to the computer-implemented method and the computer system for monitoring and controlling a multi-zone HVAC system, the present invention also relates to a computer program product comprising a non-transitory computer-readable medium which has stored thereon computer code configured to control one or more processors of a computer system for monitoring and controlling an HVAC system, which HVAC system comprises one or more fluid transportation systems with a plurality of parallel zones in each of the fluid transportation systems, such that the one or more processors perform the steps of the computer-implemented method of monitoring and controlling the multi-zone HVAC system. Specifically, the computer code is configured to control the one or more processors of the computer system, such that the one or more processors perform the steps of: receiving via a communication network from a plurality of devices of the HVAC system a plurality of operating variables of the fluid transportation systems; determining for each of the operating variables a temporal course of the respective operating variable; detecting from the temporal courses of the operating variables interdependencies between the temporal courses of the operating variables; grouping the operating variables and their associated devices into different sets, depending on the interdependencies, each set being related to a different section of the HVAC system and including the operating variables and their associated devices related to the different section of the HVAC system; and using the sets to control the HVAC system by controlling the devices of a particular section of the HVAC system, using the operating variables related to the particular section of the HVAC system, and/or generating a fault detection message regarding one or more of the devices of the particular section of the HVAC system, using the operating variables associated with the one or more devices of the particular section of the HVAC system.

BRIEF DESCRIPTION OF THE DRAWINGS

The present invention will be explained in more detail, by way of example, with reference to the drawings in which.

DETAILED DESCRIPTION OF THE PREFERRED EMBODIMENTS

Figure 1:
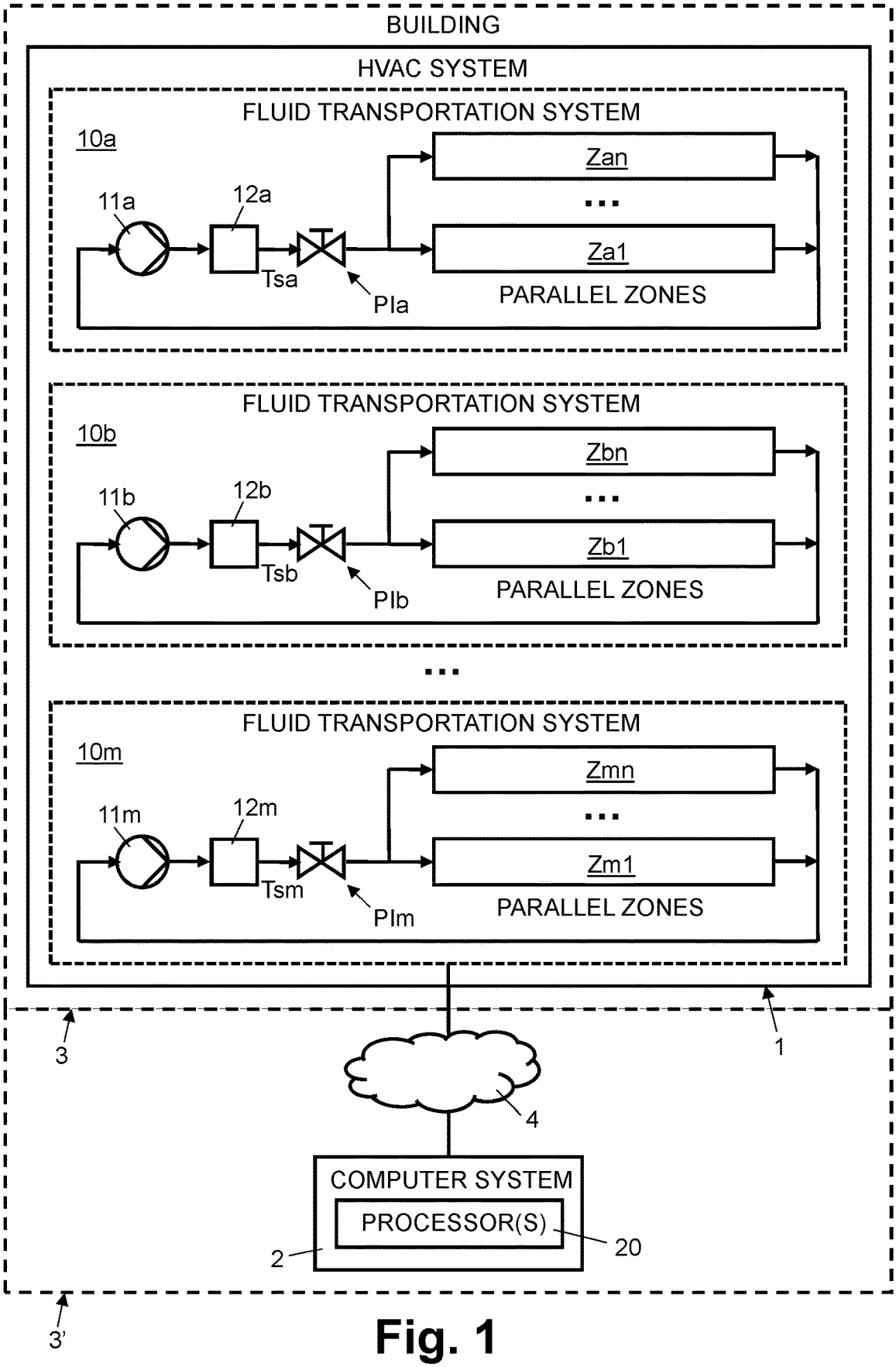
FIG. 1: shows a block diagram illustrating schematically an HVAC system with several fluid transportation systems having each several parallel zones, and a computer system for monitoring and controlling the HVAC system.

In FIG. 1, reference numeral 1 refers to an HVAC system arranged in a building 3, 3' or in several buildings. As illustrated in FIG. 1, the HVAC system 1 comprises several fluid transportation systems 10*a*, 10*b*, 10*m*. Further examples of fluid transportation systems 10, 10*c*, which could be part of the HVAC system 1 illustrated in FIG. 1 or in another HVAC system, are illustrated in FIGS. 2, 3, 4, and 5. The fluid transportation systems 10, 10*a*, 10*b*, 10*c*, 10*m* comprise circuits with fluid transport lines, e.g. pipes for liquid fluids, such as water and/or glycol, or ducts for gaseous fluids, such as air. In the examples illustrated in FIGS. 1-5, the reference numerals 10, 10*a*, 10*b*, 10*m* refer to fluid transportation systems comprising pipes for transporting liquid fluids, e.g. water. In the example of FIG. 4, the reference numeral 10*c* refers to a fluid transportation system comprising ducts for transporting gaseous fluids, e.g. air.

As illustrated in FIGS. 1-5, the transportation systems 10, 10*a*, 10*b*, 10*c*, 10*m* comprise a thermal energy source 12, 12*a*, 12*b*, 12*m*, e.g. a heater or a chiller, for heating or cooling the fluid. Each fluid transportation system 10, 10*a*, 10*b*, 10*c*, 10*m* comprises a fluid transportation driver 11, 11*a*, 11*b*, 11*m*, e.g. a pump for driving a liquid fluid or a ventilator for moving a gaseous fluid.

The fluid transportation 20, 10*a*, 10*b*, 10*c*, 10*m* systems illustrated in FIGS. 1-5 comprise a plurality of parallel zones Z1, Z2, Z3, Z4, Z5, Z6, Z7, Z8, Z9, Z10, Z11, Z28, Z29, Za1 . . . Zan, Zb1 . . . Zbn, Zm1 . . . Zmn.

To ensure pressure independent flow, the fluid transportation systems 10, 10*a*, 10*b*, 10*m* may comprise a pressure independent valve PI, PIa, PIa, PIm, PI1, PI2 as illustrated in FIGS. 1-5.

The flow to an individual zone Z1, Z2, Z3, Z4, Z5, Z6, Z7, Z8, Z9, Z10, Z11, Z28, Z29, Za1 . . . Zan, Zb1 . . . Zbn, Zm1 . . . Zmn is regulated by a valve V1, V2, V3, V4, V5, V6, V7, V8, V9, V10, V22 or damper D28, D29, respectively. As mentioned earlier, in general, the term "valve" is used herein to refer to flow control devices for liquid and gaseous fluids and, thus, is meant to include "dampers" also, unless indicated otherwise. The valves V1, V2, V3, V4, V5, V6, V7, V8, V9, V10, V11, D28, D29 are driven by actuators with electrical motors mechanically coupled to the valves.

As is illustrated in FIG. 1, the HVAC system 1 is connected via a communication network 4 to a computer system 2. The computer system 2 comprises one or more operating computers with one or more processors 20 each. As illustrated schematically in FIG. 1, the computer system 2 is arranged within the same building(s) 3' as the HVAC system 1 or outside and remote from the building(s) 3 housing the HVAC system 1. In an embodiment, the computer system 2 is a cloud-based computer system. Depending on the embodiment, the communication network 4 comprises a local area network (LAN), a wireless local area network (WLAN), a mobile radio communication network, such as GSM (Global System for Mobile Communication), UMTS (Universal Mobile Telephone System) or a 5G network, and/or the Internet.

Figure 2:
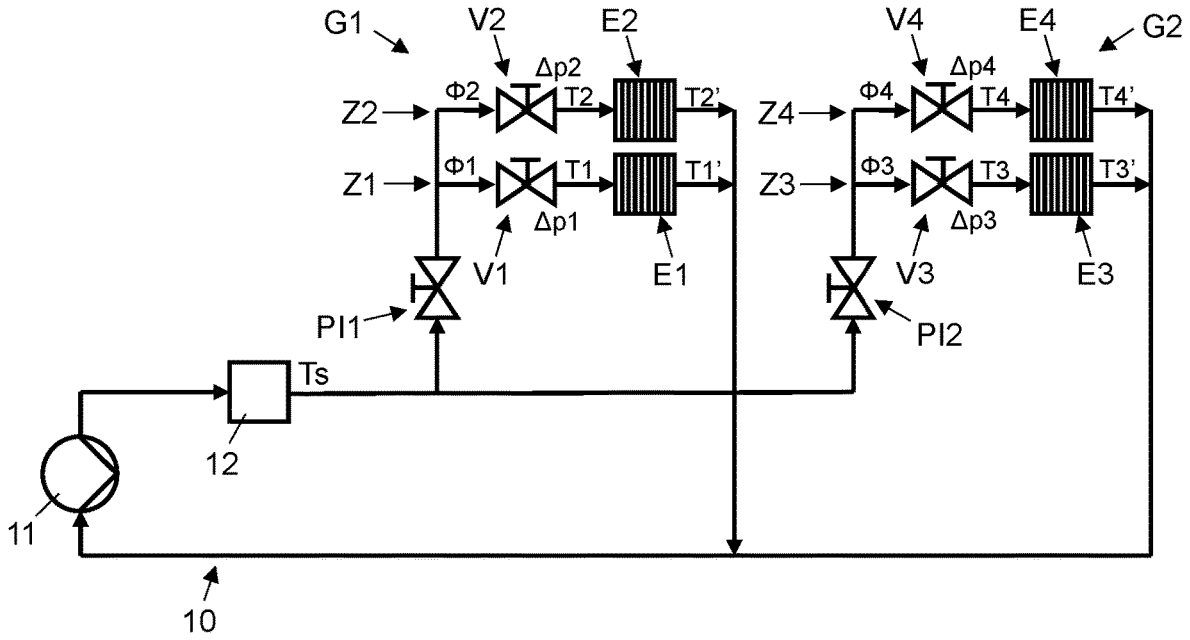
FIG. 2: shows a block diagram illustrating schematically a fluid transportation system of an HVAC system with two parallel groups of two parallel zones.

In the exemplary fluid transportation network 10 illustrated in FIG. 2, the parallel zones Z1 and Z2 are separated off as a group G1 by way of a pressure independent valve PI1 from the group G2 which comprises parallel zones Z3 and Z4. As illustrated in FIG. 2, each of the parallel zones Z1, Z2, Z3, Z4 comprises a thermal energy exchanger E1, E2, E3, E4, e.g. a radiator, and a regulating valve V1, V2, V3, V4 for regulating and adjusting the flow ϕ1, ϕ2, ϕ3, ϕ4 through the respective thermal energy exchanger E1, E2, E3, E4. Flow sensors for measuring the flow rate ϕ1, ϕ2, ϕ3, ϕ4 (and optionally flow speed) are arranged in the fluid transportation lines of the zones Z1, Z2, Z3, Z4, e.g. downstream or upstream from the valves V1, V2, V3, V4. Temperature sensors are arranged downstream and upstream of the thermal energy exchangers E1, E2, E3, E4 for measuring entry temperatures T1, T2, T3, T4 and exit temperatures T1', T2', T3', T4' of the fluid.

Figure 3:
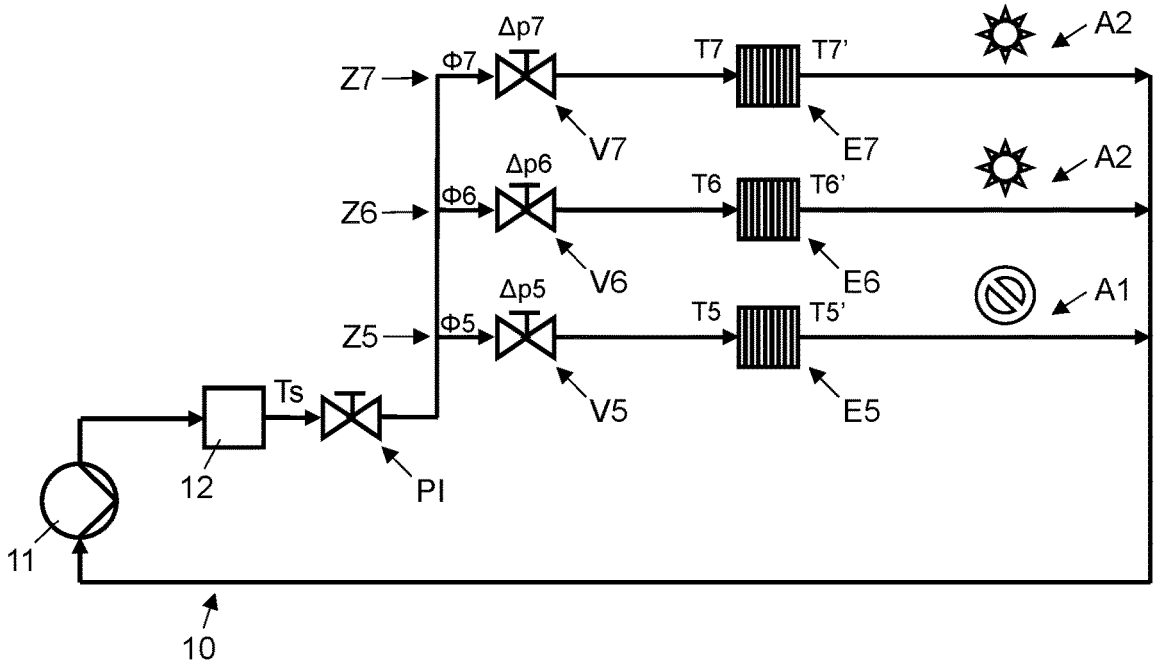
FIG. 3: shows a block diagram illustrating schematically a fluid transportation system of an HVAC system with three parallel zones.
Figure 4:
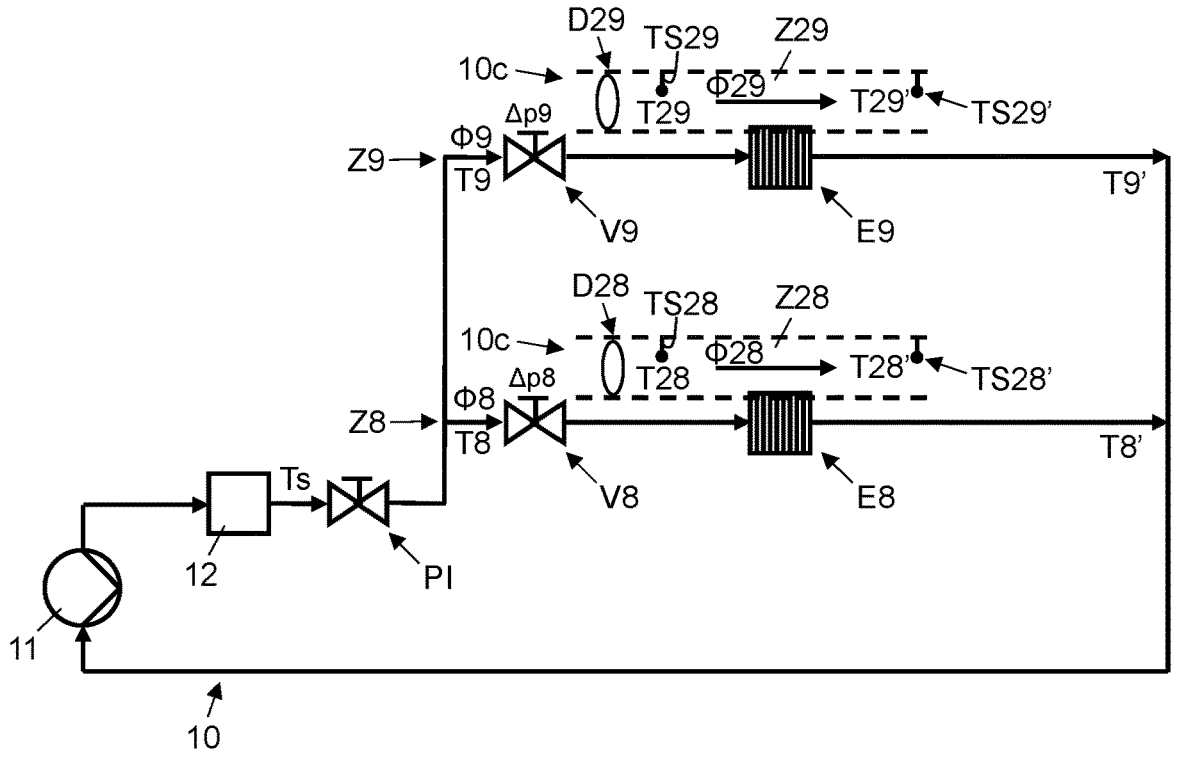
FIG. 4: shows a block diagram illustrating schematically a fluid transportation system for a primary circuit of an HVAC system with two parallel zones which are coupled via thermal energy exchangers to the fluid transportation systems of secondary circuits of the HVAC system.

In the exemplary fluid transportation network to illustrated in FIG. 3, the parallel zones Z5, Z6, Z7 comprise thermal energy exchangers E5, E6, E7 and regulating valves V5, V6, V7 for regulating and adjusting the flow ϕ5, ϕ6, ϕ7 through the thermal energy exchangers E5, E6, E7. Flow sensors for measuring the flow rate ϕ5, ϕ6, ϕ7 (and optionally flow speed) are arranged in the fluid transportation lines of the zones Z5, Z6, Z7. Temperature sensors are arranged downstream and upstream of the thermal energy exchangers E5, E6, E7 for measuring entry temperatures T5, T6, T7 and exit temperatures T5', T6', T7' of the fluid. As illustrated schematically in FIG. 3, zones Z6 and Z7 are arranged in an area A2 of the building 3, 3' which is exposed to the sun, e.g. in an area A2 facing the cardinal direction South, whereas zone Z5 is arranged in an area A1 of the building 3, 3' which is not, or at least significantly less, exposed to the sun, e.g. in an area A1 facing the cardinal direction North.

In the exemplary fluid transportation network to illustrated in FIG. 4, the parallel zones Z8, Z9 comprise thermal energy exchangers E8, E9 and regulating valves V8, V9 for regulating and adjusting the flow ϕ8, ϕ9 through the thermal energy exchangers E8, E9. Flow sensors for measuring the flow rate ϕ8, ϕ9 (and optionally flow speed) are arranged in the fluid transportation lines of the zones Z8, Z9. Temperature sensors are arranged downstream and upstream of the thermal energy exchangers E8, E9 for measuring entry (supply) temperatures T8, T9 and exit (return) temperatures T8', T9' of the fluid. As is further illustrated in the example of FIG. 4, the fluid transportation network 10 is thermically coupled to the fluid transportation network 10*c* via the thermal energy exchangers E8, E9. More specifically, in the example of FIG. 4, the thermal energy exchangers E8, E9, e.g. heat exchangers, thermically couple the fluid, e.g. water and/or glycol, being transported in the fluid transportation line of the zones Z8, Z9, which constitute primary sides or circuits of the thermal energy exchangers E8, E9, with the fluid, e.g. air, being transported in the fluid transportation lines of zones Z28, Z29, which constitute secondary sides or circuits of the thermal energy exchangers E8, E9. Temperature sensors TS28, TS29, TS28', TS29' are arranged in the fluid transportation lines of zones Z28, Z29 for measuring the entry (supply) temperatures T28, T29 and exit (return) temperatures T28', T29' of the fluid on the secondary sides. Flow sensors for measuring the flow rate ϕ28, ϕ29 (and optionally flow speed) are arranged in the fluid transportation lines of the zones Z28, Z29.

Figure 5:
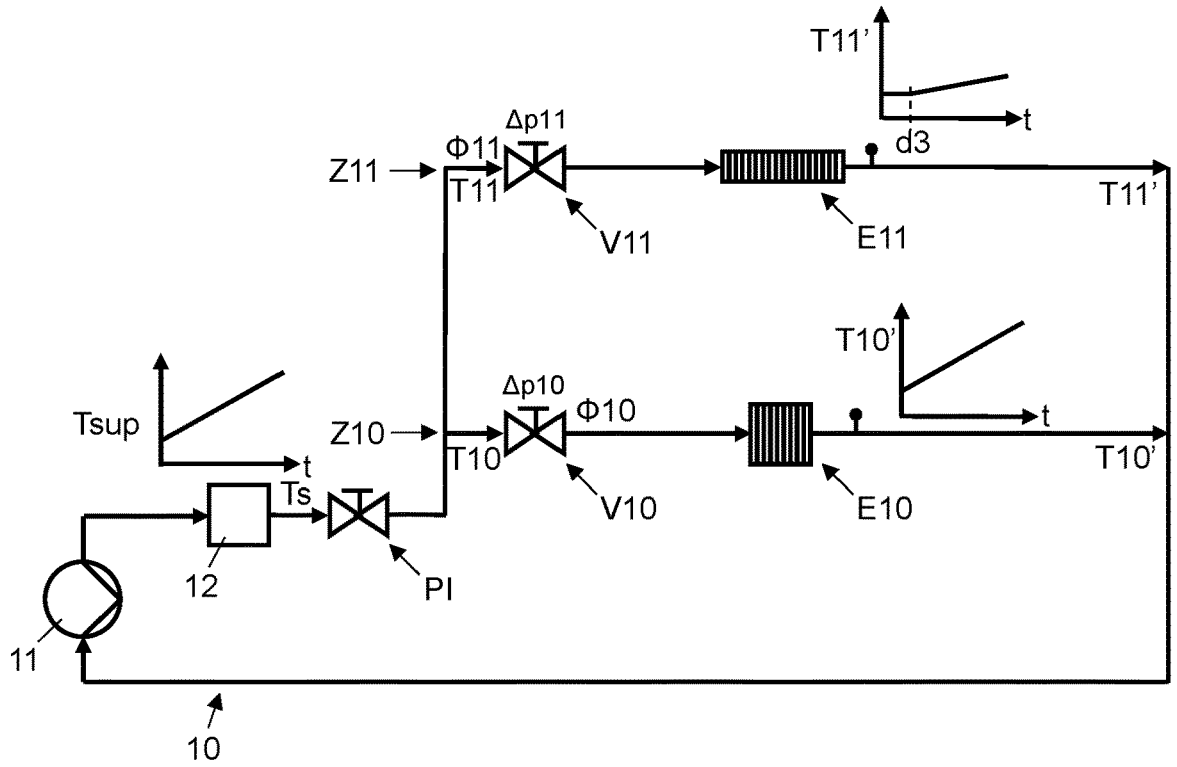
FIG. 5: shows a block diagram illustrating schematically a fluid transportation system of an HVAC system with two parallel zones whereby one of the zones comprises a thermal active building as thermal energy exchanger.

In the exemplary fluid transportation network 10 illustrated in FIG. 5, the parallel zones Z10, Z11 comprise thermal energy exchangers E10, E11 and regulating valves V10, V11 for regulating and adjusting the flow ϕ10, ϕ11 through the thermal energy exchangers E10, E11. Flow sensors for measuring the flow rate ϕ10, ϕ11 (and optionally flow speed) are arranged in the fluid transportation lines of the zones Z10, Z11. Temperature sensors are arranged downstream and upstream of the thermal energy exchangers E10, E11 for measuring entry temperatures T10, T11 and exit or return temperatures T10', T11' of the fluid. As illustrated in FIG. 5, the parallel zones Z10, Z11 comprise different types of thermal energy exchangers E10, E11; specifically, the thermal energy exchanger E11, e.g. a thermally active building (TAB), heats up significantly slower than the thermal energy exchanger E10. This fact is illustrated by the graph depicting an increasing supply temperature Tsup (T10, T11) of the fluid entering the zones Z10, Z11, whereby the exit or return temperature T10' of the thermal energy exchanger E10 shows a corresponding increase, whereas the exit or return temperature T11' of the thermal energy exchanger E11 shows a time-delayed and damped increase, by comparison.

Figure 6:
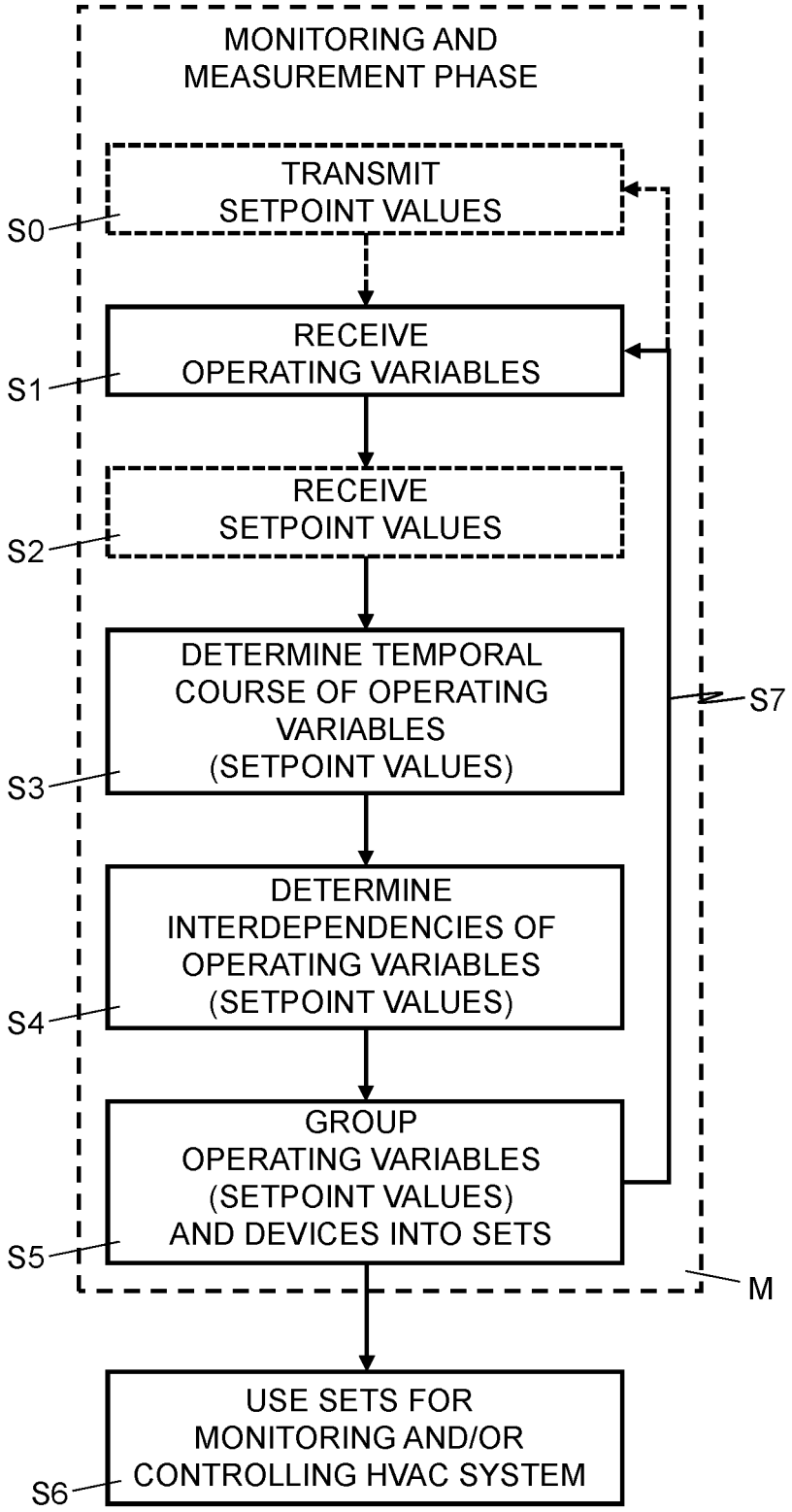
FIG. 6: shows a flow diagram illustrating schematically an exemplary sequence of steps for monitoring and controlling an HVAC system.

In the following paragraphs, described with reference to FIG. 6 are possible sequences of steps performed by the computer system 2 or its processors 20, respectively, for monitoring and controlling the HVAC system 1.

In optional step S0, the computer system 2 or its processors 20, respectively, initiate a monitoring and measurement phase M by transmitting, via the communication network 4, setpoint values to devices of the HVAC system 1. More specifically, the setpoint values are sent to valves PI, PIa, PIb, PIm, V1, V2, V3, V4, V5, V6, V7, V8, V9, V10, V11, fluid transportation drivers 11, 11*a*, 11*b*, 11*m* (pumps and/or ventilators), and/or thermal energy sources 12, 12*a*, 12*b*, 12*m* (heaters and/or chillers) of the HVAC system 1. Accordingly, the setpoint values include valve settings, such as target flow rate, valve position, valve opening degree, or actuator position, driver settings, such as pumping power, pumping speed or ventilator speed, and energy source values, such as target temperature, heating factor or chilling factor.

In step S1, the computer system 2 or its processors 20, respectively, receive, via the communication network 4, operating variables from devices of the HVAC system 1. In the embodiment or configuration where setpoint values are transmitted in step S0, the operating variables are received in step S1 in response to the transmitted setpoint values. Otherwise, the operating variables are received in step S1 on a periodic basis, e.g. as reported in push mode by the devices of the HVAC system or as requested in pull mode by the computer system 2 or its processors 20, respectively. More specifically, the operating variables are received from flow sensors, temperature sensors TS28, TS29, pressure sensors, and/or air quality sensors. The sensors are arranged and installed in the HVAC system 1 as separate individual sensors or, more typically, in association or connection with another HVAC device such as an actuator, a valve, a damper, a pump, a ventilator, a thermal energy source, e.g. a chiller or a heater, a thermal energy exchanger, e.g. a radiator or a heat exchanger, etc. The devices of the HVAC system 1 are defined by a device identifier, e.g. a unique serial number and/or communication address, such as an IP address (Internet Protocol), and optionally a device type, e.g. a sensor type, an actuator type, a valve type, a damper type, a pump type, a ventilator type, a thermal energy source type, e.g. a chiller type or a heater type, a thermal energy exchanger type, e.g. a radiator type, a heat exchanger type, etc. The operating values include flow rates ϕ1, ϕ2, ϕ3, ϕ4, ϕ5, ϕ6, ϕ7, ϕ8, ϕ9, ϕ10, ϕ11, ϕ28, ϕ29 (and optionally flow speed) of the fluid, entry (or supply) temperatures Ts, Tsa, Tsb, Tsm, T1, T2, T3, T4, T5, T6, T7, T8, T9, T10, T11 of the fluid, exit (or return) temperatures T1', T2', T3', T4', T5', T6', T7', T8', T9', T10', T11' of the fluid, differential pressures Δ1, Δ2, Δ3, Δ4, Δ5, Δ6, Δ7, Δ8, Δ9, Δ10, Δ11 of the fluid, air temperature values T28, T29, room temperature values and/or other air quality values, such as humidity, carbon monoxide level, carbon dioxide level, other VOC levels, etc. The computer system 2 or its processors 20, respectively, store the received operating variables assigned to the respective device of the HVAC system 1 which reported the operating variable, e.g. together with a time stamp provided by the respective device or by the computer system 2 or its processors 20, respectively.

In optional step S2, e.g. if optional step S0 is omitted, the computer system 2 or its processors 20, respectively, receive, via the communication network 4, setpoint values from devices of the HVAC system 1. The setpoint values are received in step S2 on a periodic basis, e.g. as reported in push mode by the devices of the HVAC system or as requested in pull mode by the computer system 2 or its processors 20, respectively. More specifically, the setpoint values are received from valves PI, PIa, PIb, PIm, V1, V2, V3, V4, V5, V6, V7, V8, V9, V10, V11, fluid transportation drivers 11, 11*a*, 11*b*, 11*m* (pumps and/or ventilators), and/or energy sources 22, 12*a*, 12*b*, 12*m* (heaters and/or chillers) of the HVAC system 1. The computer system 2 or its processors 20, respectively, store the transmitted or received set point assigned to the respective device of the HVAC system 1, e.g. together with a time stamp provided by the respective device or by the computer system 2 or its processors 20, respectively.

In step S3, the computer system 2 or its processors 20, respectively, determine the temporal courses of the received operating variables and setpoint values, if applicable. More specifically, the temporal course of a particular operating variable or setpoint value, if applicable, is determined from a plurality of recorded data values reported by the respective device of the HVAC system 1 for the particular operating variable or setpoint value over a certain period of time of the monitoring and measurement phase M, using the time stamps associated and stored with the data values. FIGS. 7*a*-7*e* and 8*a*-8*c* illustrate examples of temporal courses TC7*a*, TC7*b*, TC7*c*, TC7*d*, TC7*e*, TC8*a*, TC8*b*, TC8*c* of operating variables and/or setpoint values, collectively referenced by the reference numeral TC.

In step S4, the computer system 2 or its processors 20, respectively, determine interdependencies between the temporal courses TC of the operating variables and setpoint values, if applicable, of the HVAC system 1.

Interdependencies between the temporal courses TC include (positive and negative, damped and non-damped) correlations of the temporal courses TC of the operating variables and/or setpoint values, respectively, synchronicity in changes of the operating variables and/or setpoint values in the temporal courses TC, respectively, and synchronicity in changes and (positive and negative) correlations of the operating variables in time-shifted temporal courses of the operating variables (time-delayed correlation).

Figures 7A, 7B, 7C, 7D, 7E, 8A, 8B, 8C:
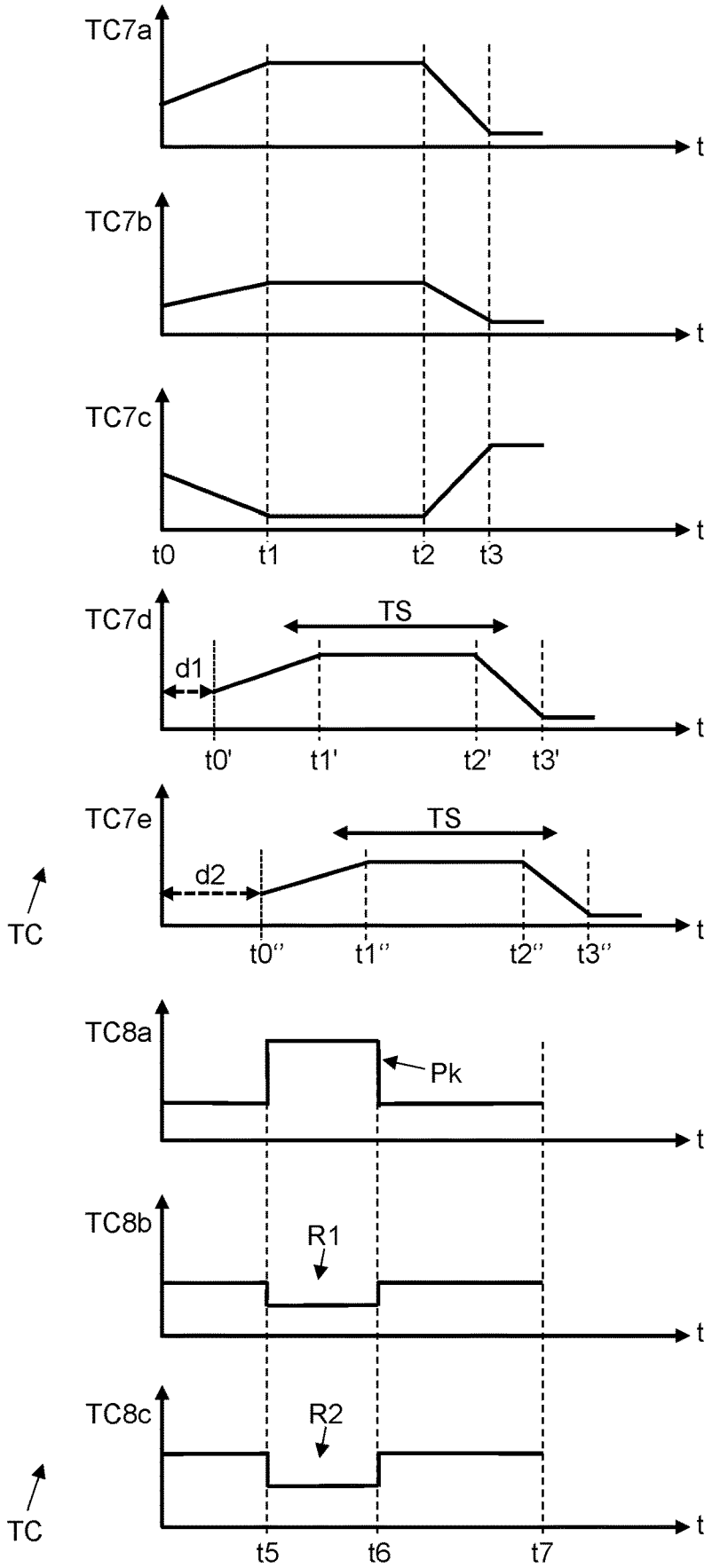
FIGS. 7*a*-7*e*: show several charts illustrating schematically examples of (correlating) temporal courses of operating variables (and/or setpoint values) of fluid transportation systems of an HVAC system.
FIGS. 8*a*-8*c*: show several charts illustrating schematically examples of (correlating) temporal courses of operating variables (and/or setpoint values) of fluid transportation systems of an HVAC system.
Figure 9:
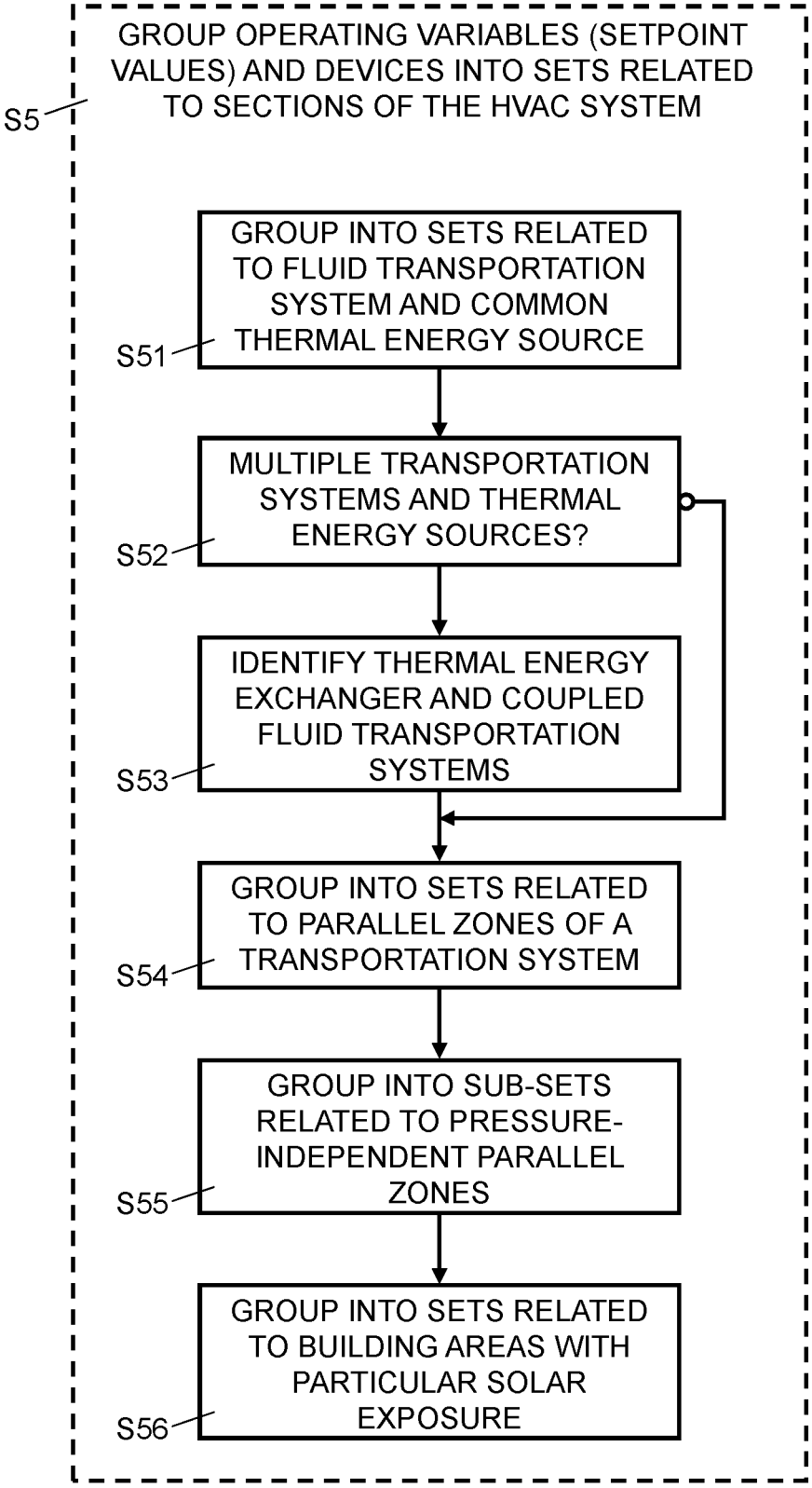
FIG. 9: shows a flow diagram illustrating schematically an exemplary sequence of steps for grouping the operating variables and their associated devices into different sets related to different sections of an HVAC system.

FIG. 7*b* shows an example of a temporal course TC7*b* of an operating variable or a setpoint value which is positively correlated with the temporal course TC7*a* of an operating variable or setpoint value illustrated in FIG. 7*a*. Compared to the temporal course TC7*a*, the temporal course TC7*b* has attenuated (damped) values of the respective operating variable or a setpoint value.

FIG. 7*c* shows an example of a temporal course TC7*c* of an operating variable or a setpoint value which is negatively correlated with the temporal course TC7*a* of an operating variable or setpoint value illustrated in FIG. 7*a*.

The temporal courses TC7*a*, TC7*b* and TC7*c* illustrated in FIGS. 7*a*, 7*b*, and 7*c* further show synchronicity in changes of the respective operating variables or setpoint values; departing from point to, the temporal courses TC7*a*, TC7*b* and TC7*c* have synchronized changes at the points in time t1, t2, and t3. Specifically, a continuous increase (or decrease, respectively) of the operating variable or setpoint value between to and t1 is changed to a constant value of the operating variable or setpoint value at t1, and the constant value of the operating variable or setpoint value is changed at t2 to a continuous decrease (or increase, respectively) of the operating variable or setpoint value, followed by a change to another constant level of the operating variable or setpoint value at t3. In an embodiment, synchronized changes of operating variables and setpoint values are detected based on the (synchronized) temporal courses of first derivatives of the temporal courses TC of the respective operating variables and setpoint values.

FIGS. 7*d* and 7*e* show examples of temporal courses TC7*d*, TC7*e* which show (time-delayed) positive correlation and synchronicity of changes with a time delay d1 or d2, respectively, to the temporal courses TC7*a*, TC7*b*, TC7*c* shown in FIGS. 7*a*, 7*b*, and 7*c*. In other words, the points in time t0', t1', t2', t3' and t0", t1", t2", t3" of the temporal courses TC7*d*, TC7*e* correspond to the points in time t0, t1, t2, t3 of the temporal courses TC7*a*, TC7*b*, TC7*c* when time-shifted by the time delays d1 or d2, respectively. Thus, the temporal courses TC7*d*, TC7*e* show synchronicity in changes and positive or negative correlation of the respective operating variables with respect to the temporal courses TC7*a*, TC7*b*, TC7*c* of operating variables when time-shifted by the respective time delays d1, d2. In an embodiment, synchronized changes and correlation of the temporal courses TC of operating variables are detected by time-shifting the temporal courses TC respectively to each other, as indicated schematically by time-shift arrow TS in FIGS. 7*d*, 7*e*, e.g. by incremental time-shift values, and checking synchronicity and/or (negative and positive) correlation of the time-shifted temporal courses TC7*d*, TC7*e* with regards to the respective other temporal courses TC7*a*, TC7*b*, TC7*c*. Interdependencies indicated by time-shifted or delayed correlation and synchronized changes are typical for fluid temperature, e.g. the water temperature, but not expected for fluid flow or fluid pressure. Another example of delayed correlation is shown in FIG. 5, where temporal course of the exit or return temperature T11' of the thermal energy exchanger E11 shows a time-delayed (time delay d3) positive (but damped) correlation with the temporal course of the supply temperature Tsup (T10, T11) of the fluid entering the zone Z10, as described above in connection with FIG. 5.

For any detected interdependency involving a time-shifted temporal course of an operating variable, the computer system 2 or its processors 20, respectively, stores the time-shift value, for which correlation and synchronicity is detected, as a time delay d1, d2, d3 value. Known time delays d1, d2 of the fluid supply temperature, e.g. water supply temperature, make it possible, for example, to determine the order and position of HVAC devices in a fluid transportation system, e.g. in terms of relative distance to a thermal energy source. One skilled in the art will understand, that depending on scenario and configuration, determining the order and position of HVAC devices in a fluid transportation system of a system may be more complicated and require combining information such as temperature, flow and pressure, as the temperature "moves" slowly when a control valve is almost closed, for example. Known time delays d3 of the fluid return temperature, e.g. water return temperature, make it possible, for example, to determine the characteristics of thermal energy exchangers in a fluid transportation system and distinguish different applications, e.g. variable air volume (VAV) applications versus thermal active building (TAB) applications, as illustrated in FIG. 5, for example.

In step S5, the computer system 2 or its processors 20, respectively, use the detected interdependencies between the temporal courses TC to group the operating variables and setpoint values of the HVAC system 1, if applicable, and their associated devices into different sets. Each set of the sets relates to a different section of the HVAC system 1 and includes the operating variables and setpoint values, if applicable, and their associated device related to the respective section of the HVAC system 1. As will be explained below in more detail, the sections of the HVAC system 1 include different fluid transportation systems 10, 10*a*, 10*b*, 10*c*, 10*m*, different parallel zones Z1, Z2, Z3, Z4, Z5, Z6, Z7, Z8, Z9, Z10, Z11, Z28, Z29, Za1 . . . Zan, Zb1 . . . Zbn, Zm1 . . . Zmn, and different areas A1, A2 of a building 3, 3' housing the HVAC system 1, and may include subsets with different groups G1, G2 of the parallel zones Z1, Z2, Z3, Z4.

As illustrated in Figure g, for grouping the operating variables and setpoint values, if applicable, and their associated HVAC devices into different sets related to different sections of the HVAC system 1, in sub-step S51 of step S5, the computer system 2 or its processors 20, respectively, use the detected interdependencies between temporal courses of fluid temperature for grouping the operating variables and their associated HVAC devices into sets related to different fluid transportation systems 10, 10*a*, 10*b*, 10*c*, 10*m* connecting the respective devices to a common thermal energy source 12, 12*a*, 12*b*, 12*m*. A detected in-sync or time-delayed correlation between the supply temperature Ts, Tsa, Tsb, Tsm of the fluid from the thermal energy source 12, 12*a*, 12*b*, 12*m* and the entry (supply) temperatures T1, T2, T3, T4, T5, T6, T7, T8, T9, T10, T11 or exit (return) temperatures T1', T2', T3', T4', T5', T6', T7', T8', T8', T10', T11' of the fluid indicates a connection of the associated HVAC devices to the same thermal energy source 12, 12*a*, 12*b*, 22*m* through the same fluid transportation system 10, 10*a*, 10*b*, 10*c*, 10*m*. It should be pointed out here that identified sets of HVAC devices associated with zones have a transitive property. For example, if in the example of FIG. 3 zones Z5 and Z6 have the same thermal energy source 12, and zones Z6 and Z7 have the same thermal energy source 12, then zones Z5 and Z7 must have the same thermal energy source 12.

In sub-step S52, the computer system 2 or its processors 20, respectively, determine whether the monitored HVAC system 1 comprises just one or a plurality of fluid transportation systems 10, 10*a*, 10*b*, 10*c*, 10*m*. If multiple fluid transportation systems 10, 10*a*, 10*b*, 10*c*, 10*m* are detected processing continues in sub-step S53; otherwise, processing continues in sub-step S54.

In sub-step S53, the computer system 2 or its processors 20, respectively, use the interdependencies detected between the temporal courses of the operating variables related to zones Z8, Z9, Z28, Z29 of different fluid transportation systems 10, 10*c* to detect and identify thermal energy exchangers E8, E9 which couple a zone Z8, Z9 of one of the detected fluid transportation systems 10 and a zone Z28, Z29 of a another one of the detected fluid transportation systems 10*c* as primary and secondary fluid circuits. Depending on the embodiment and/or configuration, the computer system 2 or its processors 20, respectively, identify the thermal energy exchanger E8, E9 by detecting the interdependencies between the temporal courses of the following pairs of operating variables:

- the flow rate ϕ8, ϕ9 of the fluid, e.g. water and/or glycol, in one of the detected fluid transportation systems 10, identified as primary circuit, and the fluid temperature T28, T29, e.g. the air temperature, in another one of the detected fluid transportation systems 10*c*, identified as the secondary circuit;
- the valve position of a valve V8, V9 in one of the detected fluid transportation systems 10, identified as primary circuit, and the fluid temperature T28, T2*g*, e.g. the air temperature, in another one of the detected fluid transportation systems 10*c*, identified as the secondary circuit;
- the fluid supply temperature T8, T9, e.g. of water and/or glycol, in one of the detected fluid transportation systems 10, identified as primary circuit, and the fluid temperature T28, T2*g*, e.g. the air temperature, in another one of the detected fluid transportation systems 10*c*, identified as secondary circuit;
- the flow rate ϕ8, ϕ9 of the fluid, e.g. water and/or glycol, in one of the detected fluid transportation systems 10, identified as primary circuit, and the valve position of a valve D28, D29, e.g. an air damper, in another one of the detected fluid transportation systems 10*c*, identified as secondary circuit;
- the valve position of a valve V8, V9 in one of the detected fluid transportation systems 10, identified as primary circuit, and the valve position of a valve D28, D29 in another one of the detected fluid transportation systems 10*c*, identified as secondary circuit;
- the fluid supply temperature T8, T9, e.g. of water and/or glycol, in one of the detected fluid transportation systems 10, identified as primary circuit, and the valve position of a valve D28, D29, e.g. an air damper, in another one of the detected fluid transportation systems 10*c*, identified as secondary circuit; and/or
- the valve position of a valve D28, D29, e.g. an air damper, in one of the detected fluid transportation systems 10*c*, identified as secondary circuit, and the fluid return temperature T8', T9', e.g. of water and/or glycol, in another one of the detected fluid transportation systems 10, identified as primary circuit.

In sub-step S54, the computer system 2 or its processors 20, respectively, use the interdependencies detected between the temporal courses of the operating variables related to one detected fluid transportation system 10, 10*a*, 10*b*, 10*c*, 10*m* for grouping the operating variables, the setpoint values and their associated HVAC devices into sets related to different parallel zones Z1, Z2, Z3, Z4, Z5, Z6, Z7, Z8, Z9, Z10, Z22, Z28, Z29, Za1 . . . Zan, Zb1 . . . Zbn, Zm1 . . . Zmn of the respective fluid transportation systems 10, 10*a*, 10*b*, 10*c*, 10*m*. As the temporal courses of the operating variables related to a particular one of the detected fluid transportation systems 10, 10*a*, 10*b*, 10*c*, 10*m* have a detected in-sync or time-delayed correlation between the supply temperature Ts, Tsa, Tsb, Tsm of the fluid from the thermal energy source 12, 22*a*, 22*b*, 12*m* and the entry temperatures T1, T2, T3, T4, T5, T6, T7, T8, T9, T10, T11 or exit (return) temperatures T1', T2', T3', T4', T5', T6', T7', T8', T9', T10', T11', as determined in sub-step S51, further grouping of HVAC devices and associated operating variables into different sets, which are each related to one parallel zone, is based on (strong) correlation of flow rates, fluid pressure and fluid temperatures.

In sub-step S55, the computer system 2 or its processors 20, respectively, use the interdependencies detected between the temporal courses of the operating variables related to the parallel zones Z1, Z2, Z3, Z4 of one of the detected fluid transportation systems 10 for grouping the operating variables, the setpoint values and their associated HVAC devices into subsets G1, G2 related to groups of parallel zones Z1, Z2, Z3, Z4, which groups are pressure-independent from each other, for example the groups G1, G2 of parallel zones Z2, Z2, Z3, Z4, are separated from each other by a pressure-independent device PI1, PI2, e.g. a pressure independent valve or a pressure-independent fluid distributor, such as a large piping system, or they are driven by separate and/or additional pumps and/or ventilators. While the operating variables of the parallel zones Z1, Z2 of a first one of the subsets G1 or groups show a positive or negative correlation, the operating variables of the parallel zones Z3, Z4 of the other subset G2 or group remain essentially independent and not affected by the changes of the operating variables of the parallel zones Z1, Z2 of said first one of the subsets G1 or groups.

In sub-step S56, the computer system 2 or its processors 20, respectively, use the interdependencies detected between the temporal courses of the operating variables and setpoint values related to the parallel zones Z5, Z6, Z7 for grouping the operating variables, the setpoint values and their associated HVAC devices into sets related to a particular area A1, A2 of the building 3, 3' which houses the HVAC system 1. More specifically, the particular areas A1, A2 of the building 3, 3' are characterized by a respective thermal load. For example, the particular areas A1, A2 of the building 3, 3' are characterized by their orientation with regards to a particular cardinal direction, e.g. South or North, with a respective solar exposure. For example, in a cooling application, the operating variables and setpoint values of the parallel zones Z6, Z7 related to a first area A2, which is oriented towards South with a high degree of solar exposure, show a positive correlation with respect to a high thermal load, e.g. defined by an upper thermal threshold and expressed by one or more of the respective operating variables and setpoint values, whereas the operating variables and setpoint values of the parallel zones Z5 related to a second area A1, which is oriented towards North with a comparatively low degree of solar exposure, show a positive correlation with respect to comparatively low thermal load, e.g. defined by a lower thermal threshold and expressed by one or more of the respective operating variables and setpoint values.

In an embodiment, the computer system 2 or its processors 20, respectively, use the interdependencies detected between the temporal courses of room temperatures and other operating variables and setpoint values related to the parallel zones Z1, Z2, Z3, Z4, Z5, Z6, Z7, 25 Z8, Z9, Z10, Z22, Z28, Z29, Za1 . . . Zan, Zb1 . . . Zbn, Zm1 . . . Zmn for grouping the operating variables, the setpoint values and their associated HVAC devices into sets related to a particular area or room of the building 3, 3' which houses the HVAC system 1.

One skilled in the art will understand, that the groupings, i.e. the sets and subsets, constitute a configuration or construction model of the HVAC system 1. The configuration or construction model of the HVAC system 1, as generated by the computer system 2 or its processors 20, respectively, and defined by the sets and subsets, is structured into one or more fluid transportation systems 10, 10*a*, 10*b*, 10*c*, 10*m*, which comprise one or more parallel zones Z1, Z2, Z3, Z4, Z5, Z6, Z7, Z8, Z9, Z10, Z22, Z28, Z29, Za1 . . . Zan, Zb1 . . . Zbn, Zm1 . . . Zmn, and subsets of pressure-independent groups G1, G2 of parallel zones Z1, Z2, Z3, Z4. The sets and subsets related to a particular zone Z1, Z2, Z3, Z4, Z5, Z6, Z7, Z8, Z9, Z10, Z22, Z28, Z29, Za1 . . . Zan, Zb1 . . . Zbn, Zm1 . . . Zmn further indicate the devices of the HVAC system 1 associated with and arranged in the respective zone and include the temporal courses of the operating variables and setpoint values related to and measured by the HVAC devices of the zone. The configuration or construction model of the HVAC system 1, as defined by the sets and subsets, further comprises (delay-based) position information for the parallel zones Z1, Z2, Z3, Z4, Z5, Z6, Z7, Z8, Z9, Z10, Z71, Z28, Z29, Za1 . . . Zan, Zb1 . . . Zbn, Zm1 . . . Zmn and their HVAC devices, defining the devices' relative position to each other in a fluid transportation system 10, 10*a*, 10*b*, 10*c*, 10*m* and with respect to a thermal energy source 12, 12*a*, 12*b*, 12*m*.

The configuration or construction model of the HVAC system 1, further indicates the fluid transportation systems 10, 10*c* which are thermally coupled by identified thermal energy exchanging devices E8, E9 arranged in specific zones Z8, Z9, Z28, Z29 of the respective fluid transportation systems 10, 10*c*. The configuration or construction model of the HVAC system 1, further comprises location information with regards to a zone's position in the building(s) 3, 3' housing the HVAC system 1, including areas A1, A2 with different solar exposure and specific rooms of the building 3, 3'.

In step S6, the computer system 2 or its processors 20, respectively, use the configuration or construction model of the HVAC system 1, i.e. the sets and subsets with the grouping of the operating variables and setpoint values with their associated devices of the HVAC system 1, for monitoring and/or controlling operation and performance of the HVAC system 1. Specifically, the computer system 2 or its processors 20, respectively, use the generated configuration or construction model of the HVAC system 1 and the related operating variables and setpoint values for monitoring and analyzing the operation and performance of the HVAC system 1, and to generate fault detection messages regarding one or more of the devices of the HVAC system 1 and/or control one or more devices of the HVAC system 1 for an improved or optimized performance of the HVAC system 1, depending on the analysis of the operation and performance of the HVAC system 1. The fault detection messages are transmitted to one or more communication terminals associated with the HVAC system 1.

For example, as illustrated in FIGS. 8*a*-8*c*, the temporal courses TC8*a*, TC8*b*, TC8*c* of the flow rate of parallel zones Z5, Z6, Z7 (shown in FIG. 3) have interdependencies where the flow rates ϕ5, ϕ6 of zones Z5 and Z6 (represented by temporal courses TC8*b*, TC8*c*) show a negative correlation with the flow rate ϕ7 of zone Z8 (represented by temporal course TC8*a*). Further analysis of the setpoint values related to the valves V5, V6, V7 of zones Z5, Z6, Z7 by the computer system 2 or its processors 20, respectively, reveals that the peak Pk of the flow rate ϕ7 in the temporal course TC8*a* is based on a high demand for zone Z7, whereas the drop or reductions R1, R2 of the flow rates ϕ5, ϕ6 of zones Z5 and Z6 is not a result of corresponding lower setpoint values for the valves V5, V6 of zones Z5, Z6, but a consequence of the comparatively higher demand or setpoint value for the valve V7 of zone Z7 (valve V7 or zone Z7 is "stealing flow" from zones Z5 and Z6). Upon repeated detection of such a scenario, the computer system 2 or its processors 20, respectively, generate a respective alert message and/or implement and perform a peak shaving scheme, whereby the Pk of the flow rate ϕ7 in the temporal course TC8*a* is reduced, such that the drop or reductions R1, R2 of the flow rates ϕ5, ϕ6 can be prevented in zones Z5 and Z6. In accordance with the results of the peak shaving scheme, the computer system 2 or its processors 20, respectively, transmit adapted setpoint values to the HVAC system 1, e.g. to the valves V5, V6, V7 or respective actuators of zones Z5, Z6, Z7.

In another example, the computer system 2 or its processors 20, respectively, detect an oscillation of one or more operating variables related to one or more fluid transportation systems 10*a*, 10*b*, 10*c*, 10*m*, 10. Upon detection of oscillation, the computer system 2 or its processors 20, respectively, set (define and transmit) altered timing parameters for the devices related to the respective one or more fluid transportation systems 10*a*, 10*b*, 10*c*, 10*m*, 10, such as to obtain a more stable operation and performance of the HVAC system 1.

In another example, the computer system 2 or its processors 20, respectively, use the generated configuration or construction model of the HVAC system 1 and the temporal courses of the related operating variables and setpoint values, extending over an extended period of time of several days, e.g. one week or a month or longer, for determining an HVAC system schedule which indicates repeated and recurring patterns of operation of the HVAC system 1. Based on the HVAC system schedule and continued monitoring of the HVAC system 1, the computer system 2 or its processors 20, respectively, generate alert messages which indicate detected deviations from the HVAC system schedule, e.g. a clogged heat exchanger or valve, and/or help messages which indicate suggested changes of the HVAC system schedule for a more energy efficient operation of the HVAC system 1, e.g. to adjust the loads in accordance with observed boiler capacity (from the observed cumulative flow of fluid and energy) and schedule, such that peak demands are not colliding with a recharge of the boiler. The alert messages and/or help messages, respectively, are transmitted to one or more communication terminals associated with the HVAC system 1. In an embodiment, based on the HVAC system schedule and continued monitoring of the HVAC system 1, the computer system 2 or its processors 20, respectively, determine (select and/or generate) changes to the schedule, control procedures, and/or control parameters for the HVAC system for a more energy efficient operation of the HVAC system 1, and transmit the changes via the communication network 4 to the HVAC system 1 and its components.

In further examples and embodiments, the computer system 2 or its processors 20, respectively, use the generated configuration or construction model of the HVAC system 1 and the temporal courses of the related operating variables and setpoint values:

to detect unbalanced load scenarios, e.g. for corresponding room temperatures (targeted and achieved) in adjacent rooms, the thermal load of the zones related to these rooms is unbalanced such that a room is heated by an adjacent room, and implement and perform a load balancing scheme for a more balanced operation of the HVAC system 1;

to detect under-supply scenarios where one zone consumes flow rate at the expense of another zone (see related example above), and implement and perform an adjusted flow distribution scheme for a more balanced operation of the HVAC system 1;

to implement and perform a fluid transportation driver 11, 11*a*, 11*b*, 11*m* optimization scheme for reducing required pumping power, for example, by maximizing the opening levels of the valves PI, PIa, PIb, PIm, V1, V2, V3, V4, V5, V6, V7, V8, V9, V10, V11 of the HVAC system 1 while maintaining the required flow rates; and/or to improve and optimize the schedule for the thermal energy sources 12, 12*a*, 12*b*, 22*m*, by determining the duration of time for heating up and/or cooling down of the rooms of the building 3, 3' and schedule the production of thermal energy by the thermal energy sources 12, 12*a*, 12*b*, 12*m* accordingly for a more energy efficient operation of the HVAC system 1.

In accordance with the results of the respective optimization scheme, the computer system 2 or its processors 20, respectively, transmit the adapted setpoint values to the HVAC system 1, e.g. to the respective devices of the HVAC system 1.

It should be noted that, in the description, the sequence of the steps has been presented in a specific order, one skilled in the art will understand, however, that at least some of the steps could be altered, without deviating from the scope of the invention.

The invention claimed is:

1. A computer-implemented method of monitoring and controlling an HVAC system which comprises one or more fluid transportation systems with a plurality of parallel zones in each of the fluid transportation systems, the method comprising one or more processors of a computer system performing the steps of:

receiving via a communication network from a plurality of devices of the HVAC system a plurality of operating variables of the fluid transportation systems;

determining for each of the operating variables a temporal course of the respective operating variable from a plurality of recorded data values received over time for the respective operating variable;

detecting from the temporal courses of the operating variables interdependencies between the temporal courses of the operating variables, the interdependencies including correlations of the temporal courses of the operating variables, synchronicity in changes of the operating variables in the temporal courses, and synchronicity in changes and correlations of the operating variables in time-shifted temporal courses of the operating variables;

grouping the operating variables and their associated devices into different sets, depending on the interdependencies, each set being related to a different section of the HVAC system and including the operating variables and their associated devices related to the different section of the HVAC system; and using the sets to control the HVAC system to heat, ventilate, air condition and/or cool one or more buildings by controlling devices of a particular section of the HVAC system, using the operating variables related to the particular section of the HVAC system, using the operating variables associated with the one or more devices of the particular section of the HVAC system.

2. The method of claim 1, further comprising the one or more processors receiving via the communication network from a plurality of devices of the HVAC system a plurality of setpoint values for the operating variables of the fluid transportation systems; determining for each of the setpoint values a temporal course of the respective setpoint value; detecting from the temporal courses of the setpoint values interdependencies between the temporal courses of the setpoint values; and using the interdependencies between the temporal courses of the setpoint values for grouping the setpoint values and their associated devices into the different sets.

3. The method of claim 1, wherein the operating variables of the fluid transportation systems comprise a fluid temperature; and the method further comprises the one or more processors detecting the interdependencies by determining correlations of the temporal courses of the fluid temperature, and grouping the operating variables and their associated devices into sets which are related to a different one of the fluid transportation systems and include the operating variables and their associated devices connected by the different one of the fluid transportation systems to a common thermal energy source.

4. The method of claim 3, further comprising the one or more processors identifying in the HVAC system thermal energy exchanging devices which couple a zone of a first one of the fluid transportation systems and a zone of a second one of the fluid transportation systems as primary and secondary fluid circuits, by detecting interdependencies between the temporal courses of the operating variables grouped into sets related to different fluid transportation systems and zones.

5. The method of claim 4, further comprising the one or more processors identifying the thermal energy exchanging devices by detecting the interdependencies between the temporal courses of at least one of the following pairs of operating variables: flow (Φ8, Φ9(Of fluid in a first fluid transportation system and fluid temperature in a second fluid transportation system, valve position of a valve in a first fluid transportation system and the fluid temperature in a second fluid transportation system, fluid supply temperature in the first fluid transportation system and fluid temperature in the second fluid transportation system, flow (Φ8, Φ8, Φ9) of fluid in a first fluid transportation system and valve position of a valve in a second fluid transportation system, valve position of a valve in a first fluid transportation system and valve position of a valve in a second fluid transportation system, fluid supply temperature in the first fluid transportation system and valve position of a valve in a second fluid transportation system, and valve position of a valve in the second fluid transportation system and fluid return temperature in the first fluid transportation system.

6. The method of claim 1, further comprising the one or more processors grouping the operating variables and their associated devices into sets which are related to a different zone of one of the fluid transportation systems and include the operating variables and their associated devices related to the different zone of the one of the fluid transportation systems.

7. The method of claim 6, further comprising the one or more processors dividing the operating variables and their associated devices from the sets which are related to the different zones of a particular one of the fluid transportation systems into subsets which are related to parallel zones which are pressure-independent from the other zones of the particular one of the fluid transportation system.

8. The method of claim 1, further comprising the one or more processors grouping the operating variables and their associated devices into sets which are each related to a particular area of a building which houses the HVAC system, the particular area of the building being characterized by a respective thermal load, and include the operating variables and their associated devices related to the particular area of the building.

9. The method of claim 1, wherein the operating variables of the fluid transportation systems comprise at least one of: temperature of fluid, flow rate of the fluid, and pressure of the fluid; and the method further comprises the one or more processors detecting the interdependencies by determining correlations of the temporal courses of at least one of: temperature of fluid, flow rate of the fluid, and pressure of the fluid.

10. The method of claim 1, further comprising the one or more processors detecting the interdependencies by determining from the temporal courses of the operating variables a synchronicity in changes of the operating variables.

11. The method of claim 1, further comprising the one or more processors time-shifting the temporal courses of the operating variables, and detecting the interdependencies by determining a synchronicity in changes of the operating variables and/or a correlation of the operating variables using time-shifted temporal courses of the operating variables.

12. The method of claim 1, further comprising the one or more processors detecting from the temporal courses of the operating variables time delays between changes of the operating variables, and determining relative positions of the devices of the HVAC systems in the fluid transportation systems, using the time delays.

13. The method of claim 1, further comprising the one or more processors grouping the operating variables and their associated devices into sets which are related to parallel zones of a particular one of the fluid transportation systems, each of the sets including the operating variables and their associated devices related to one of the parallel zones; and using the operating variables of the parallel zones of the particular one of the fluid transportation systems to control the devices of the parallel zones according to at least one of: a load balancing scheme, a peak shaving scheme, an adjusted flow distribution scheme for under-supply scenarios, and a fluid transportation driver optimization scheme.

14. The method of claim 1, further comprising the one or more processors grouping the operating variables and their associated devices into sets which are each related to a particular one of the fluid transportation systems and include the operating variables and their associated devices related to the particular one of the fluid transportation systems; detecting oscillation of the operating variables related to the particular one of the fluid transportation systems; and setting altered timing parameters for the devices related to the particular one of the fluid transportation systems, upon detection of oscillation.

15. The method of claim 1, further comprising the one or more processors receiving via the communication network from a plurality of sensor devices of the HVAC system a plurality of room temperature values; determining for each of the sensor devices a temporal course of the room temperature value; detecting interdependencies between the temporal courses of the room temperature values and the temporal courses of the operating variables; using the interdependencies between the temporal courses of the room temperature values and the temporal courses of the operating variables for assigning the sensor devices and their room temperature values to the different sets; and controlling the devices of a particular section of the HVAC system, using the room temperature values related to the particular section of the HVAC system.

16. The method of claim 1, further comprising the one or more processors performing a system measurement phase by transmitting via the communication network to a plurality of devices of the HVAC system a plurality of setpoint values for the operating variables of the fluid transportation systems, and receiving the plurality of operating variables of the fluid transportation systems from the plurality of devices of the HVAC system in response to transmitting the setpoint values.

17. The method of claim 1, further comprising the one or more processors using the operating variables of the particular section of the HVAC system to determine an HVAC system schedule, and using the HVAC system schedule to generate at least one of: an alert message indicative of detected a deviation from the HVAC system schedule, and a help message indicative of a suggested change of the HVAC system schedule for a more energy efficient operation of the HVAC system.

18. A computer system for monitoring and controlling an HVAC system which comprises one or more fluid transportation systems with a plurality of parallel zones in each of the fluid transportation systems, the computer system comprising one or more processors configured to perform the steps of the method of claim 1.

19. A non-transitory computer-readable medium which has stored thereon computer code configured to, which accessed and executed by one or more processors of a computer system for monitoring and controlling an HVAC system, which HVAC system comprises one or more fluid transportation systems with a plurality of parallel zones in each of the fluid transportation systems, the one or more processors perform the steps of the method of claim 1.

20. A computer-implemented method of monitoring and controlling an HVAC system which comprises one or more fluid transportation systems with a plurality of parallel zones in each of the fluid transportation systems, the method comprising one or more processors of a computer system performing the steps of:

receiving via a communication network from a plurality of devices of the HVAC system a plurality of operating variables of the fluid transportation systems, the operating variables of the fluid transportation systems comprising a fluid temperature;

determining for each of the operating variables a temporal course of the respective operating variable;

detecting from the temporal courses of the operating variables interdependencies between the temporal courses of the operating variables by determining correlations of the temporal courses of the fluid temperature;

grouping the operating variables and their associated devices into different sets, depending on the interdependencies, the sets being related to a different one of the fluid transportation systems and including the operating variables and their associated devices connected by the different one of the fluid transportation systems to a common thermal energy source;

identifying in the HVAC system thermal energy exchanging devices which couple a zone of a first one of the fluid transportation systems and a zone of a second one of the fluid transportation systems as primary and secondary fluid circuits, by detecting the interdependencies between the temporal courses of at least one of the following pairs of operating variables: flow of fluid in a first fluid transportation system and fluid temperature in a second fluid transportation system, valve position of a valve in a first fluid transportation system and the fluid temperature in a second fluid transportation system, fluid supply temperature in the first fluid transportation system and fluid temperature in the second fluid transportation system, flow of fluid in a first fluid transportation system and valve position of a valve in a second fluid transportation system, valve position of a valve in a first fluid transportation system and valve position of a valve in a second fluid transportation system, fluid supply temperature in the first fluid transportation system and valve position of a valve in a second fluid transportation system, or valve position of a valve in the second fluid transportation system and fluid return temperature in the first fluid transportation system; and using the sets to control the HVAC system to heat, ventilate, air condition and/or cool one or more buildings by controlling devices of a particular section of the HVAC system, using the operating variables related to the particular section of the HVAC system, using the operating variables associated with the one or more devices of the particular section of the HVAC system.

21. A computer-implemented method of monitoring and controlling an HVAC system which comprises one or more fluid transportation systems with a plurality of parallel zones in each of the fluid transportation systems, the method comprising one or more processors of a computer system performing the steps of:

receiving via a communication network from a plurality of devices of the HVAC system a plurality of operating variables of the fluid transportation systems;

determining for each of the operating variables a temporal course of the respective operating variable from a plurality of recorded data values received over time for the respective operating variable;

detecting from the temporal courses of the operating variables interdependencies between the temporal courses of the operating variables, the interdependencies including correlations of the temporal courses of the operating variables, synchronicity in changes of the operating variables in the temporal courses, and synchronicity in changes and correlations of the operating variables in time-shifted temporal courses of the operating variables;

grouping the operating variables and their associated devices into different sets, depending on the interdependencies, each set being related to a different section of the HVAC system and including the operating variables and their associated devices related to the different section of the HVAC system; and using the sets to control the HVAC system to heat, ventilate, air condition and/or cool one or more buildings by controlling devices of a particular section of the HVAC system, using the operating variables related to the particular section of the HVAC system, and generating a fault detection message regarding one or more of the devices of the particular section of the HVAC system, using the operating variables associated with the one or more devices of the particular section of the HVAC system.

22. A computer-implemented method of monitoring and controlling an HVAC system which comprises one or more fluid transportation systems with a plurality of parallel zones in each of the fluid transportation systems, the method comprising one or more processors of a computer system performing the steps of:

receiving via a communication network from a plurality of devices of the HVAC sys-tem a plurality of operating variables of the fluid transportation systems, the operating variables of the fluid transportation systems comprising a fluid temperature;

determining for each of the operating variables a temporal course of the respective operating variable;

detecting from the temporal courses of the operating variables interdependencies between the temporal courses of the operating variables by determining correlations of the temporal courses of the fluid temperature;

grouping the operating variables and their associated devices into different sets, depending on the interdependencies, the sets being related to a different one of the fluid transportation systems and including the operating variables and their associated devices connected by the different one of the fluid transportation systems to a common thermal energy source;

identifying in the HVAC system thermal energy exchanging devices which couple a zone of a first one of the fluid transportation systems and a zone of a second one of the fluid transportation systems as primary and secondary fluid circuits, by detecting the interdependencies between the temporal courses of at least one of the following pairs of operating variables: flow of fluid in a first fluid transportation system and flu-id temperature in a second fluid transportation system, valve position of a valve in a first fluid transportation system and the fluid temperature in a second fluid transportation system, fluid supply temperature in the first fluid transportation system and fluid temperature in the second fluid transportation system, flow of fluid in a first flu-id transportation system and valve position of a valve in a second fluid transportation system, valve position of a valve in a first fluid transportation system and valve position of a valve in a second fluid transportation system, fluid supply temperature in the first fluid transportation system and valve position of a valve in a second fluid transportation system, or valve position of a valve in the second fluid transportation system and fluid return temperature in the first fluid transportation system; and using the sets to control the HVAC system to heat, ventilate, air condition and/or cool one or more buildings by controlling devices of a particular section of the HVAC system, using the operating variables related to the particular section of the HVAC system, and generating a fault detection message regarding one or more of the devices of the particular section of the HVAC system, using the operating variables associated with the one or more devices of the particular section of the HVAC system.

* * * * *